US005706359A

United States Patent [19]

Chang

[11] Patent Number: 5,706,359

[45] Date of Patent: Jan. 6, 1998

[54] HANDHELD MICROPHONE WITH A SHOCKMOUNT SYSTEM

[76] Inventor: Ching-Lu Chang, No. 39, Lane 29, Shih-Chia Rd., Tung Dist., Taichung City, Taiwan

[21] Appl. No.: 782,780

[22] Filed: Jan. 13, 1997

[51] Int. Cl.[6] ..... H04R 25/00

[52] U.S. Cl. ..... 381/169; 381/168

[58] Field of Search ..... 381/115, 122, 381/157, 168, 169, 170, 177, 205

[56] References Cited

U.S. PATENT DOCUMENTS 3,061,690 10/1962 Swinehart ..... 381/177
4,910,795 3/1990 McCowen et al. ..... 381/168

FOREIGN PATENT DOCUMENTS 2223145 3/1990 United Kingdom ..... 381/169

*Primary Examiner*—Huyen D. Le
*Attorney, Agent, or Firm*—Harness, Dickey & Pierce, P.L.C.

[57] ABSTRACT

A handheld microphone includes a housing, a pick-up device, and a shockmount member. The housing includes a hollow handle member, a coupling member fastened to the hollow handle member, and a perforated cap fastened to the coupling member. One end of the coupling member is formed with a recess with a base wall that has an opening. The pick-up device has a pick-up head extending into the cap, a tubular end portion extending into the coupling member, and an axial shank extending through the opening and fastened to the base wall. The shockmount member is mounted between the pick-up head and the tubular end portion, and has a rigid inner ring portion which is disposed between the pick-up head and the tubular end portion and which confines an axial hole for passage of the shank therethrough, a resilient inner ring portion which substantially encloses the rigid inner ring portion, a rigid outer ring portion which is disposed around the rigid inner ring portion, a resilient outer ring portion which is secured to an inner side of the rigid outer ring portion, and a resilient connector which interconnects the resilient inner and outer ring portions. The rigid outer ring portion is fastened to the coupling member.

8 Claims, 5 Drawing Sheets

HANDHELD MICROPHONE WITH A SHOCKMOUNT SYSTEM

BACKGROUND OF THE INVENTION

1. Field of the Invention

The present invention relates to a handheld microphone, more particularly to a handheld microphone with a shockmount system.

2. Description of the Related Art

A conventional handheld microphone usually generates static noise when handling the same since the conventional microphone includes magnetic components which are relatively sensitive to vibrations. It is thus desired to provide a microphone which can be protected and isolated from external vibrations.

SUMMARY OF THE INVENTION

The object of this invention is to provide a handheld microphone with a shockmount member so as to minimize the presence of static noise.

Accordingly, the handheld microphone of this invention includes a housing, a pick-up device, and a shockmount member. The housing includes a hollow handle member, a coupling member having a first threaded end fastened to the hollow handle member and a second threaded end, and a perforated cap fastened to the second threaded end of the coupling member. The first threaded end of the coupling member is formed with a recess which has a base wall. The base wall is formed with an opening. The pick-up device has a pick-up head extending into the cap, a tubular end portion extending into the coupling member, and an axial shank which extends through the opening in the base wall and which is fastened to the base wall by means of a nut. The shockmount member is mounted between the pick-up head and the tubular end portion of the pick-up device. The shockmount member has a rigid inner ring portion which is disposed between the pick-up head and the tubular end portion of the pick-up device and which confines an axial hole for passage of the shank of the pick-up device therethrough, a resilient inner ring portion which substantially encloses the rigid inner ring portion, a rigid outer ring portion which is disposed around the rigid inner ring portion, a resilient outer ring portion which is secured to an inner side of the rigid outer ring portion, and a resilient connector which interconnects the resilient inner and outer ring portions. The rigid outer ring portion is fastened to the second threaded end of the coupling member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
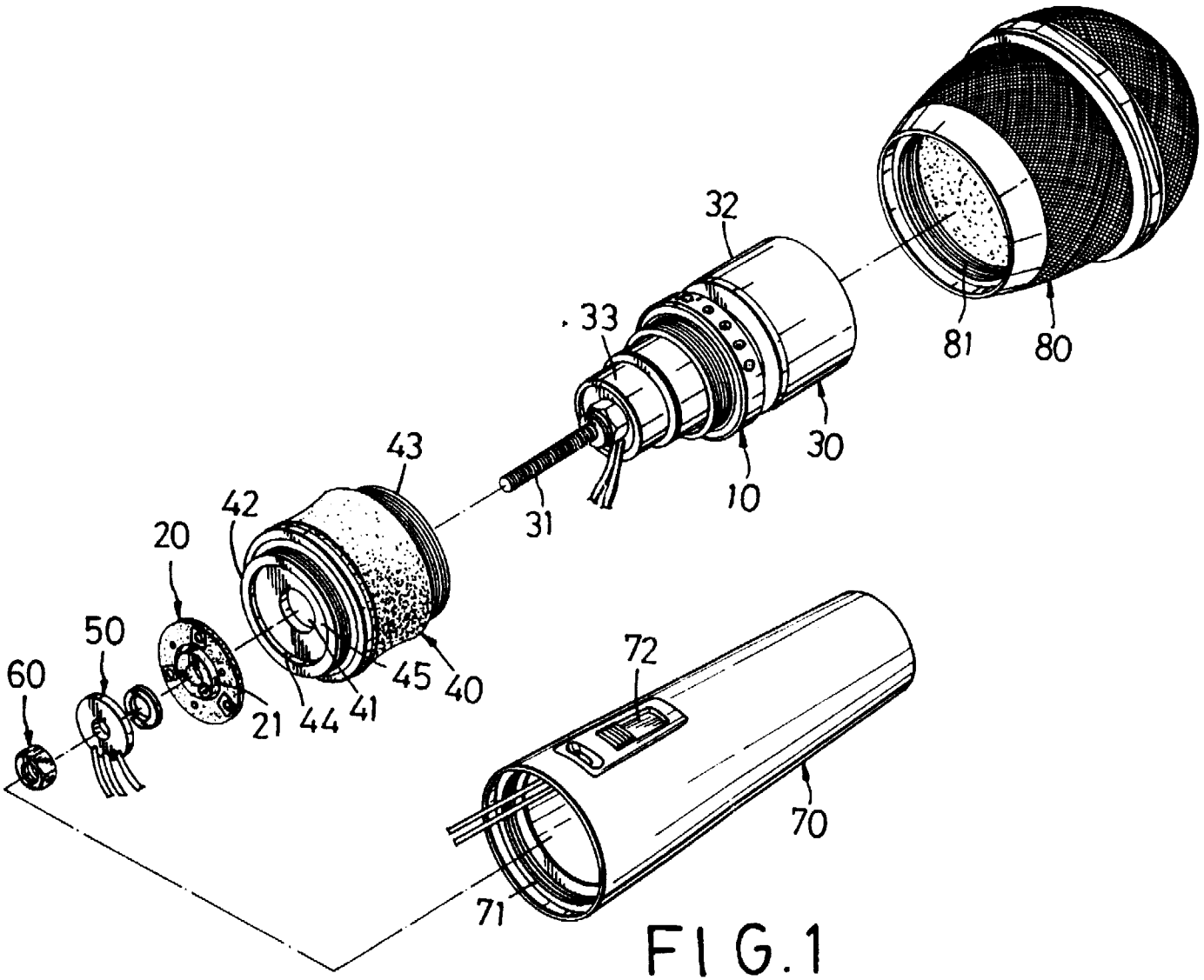
FIG. 1 is an exploded perspective view illustrating a handheld microphone according to a first preferred embodiment of the present invention.

Referring to FIG. 1, the handheld microphone according to a first preferred embodiment of the present invention is shown to include a housing which has a hollow handle member 70, a coupling member 40 and a perforated cap 80. The coupling member 40 has a first threaded end 42 fastened to an internally threaded open end 71 of the hollow handle member 70, and a second threaded end 43 fastened to an internally threaded open end 81 of the perforated cap 80. The first threaded end 42 of the coupling member 40 is formed with a recess 44 which has a base wall 45. The base wall 45 is formed with an opening 41. The second threaded end 43 is formed with an internal screw thread (not shown).

The handheld microphone of the first preferred embodiment further includes a pick-up device 30, a first shockmount member 10, a second shockmount member 20, and a circuit board 50 connected electrically with the pick-up device 30 and a switch 72 that is mounted on the hollow handle member 70.

The pick-up device 30 has a pick-up head 32 extending into the cap 80, a tubular end portion 33 extending into the coupling member 40, and an axial shank 31 which extends through the opening 41 in the base wall 45 of the coupling member 40 and which is fastened to the base wall 45 by means of a nut 60.

Figure 2:
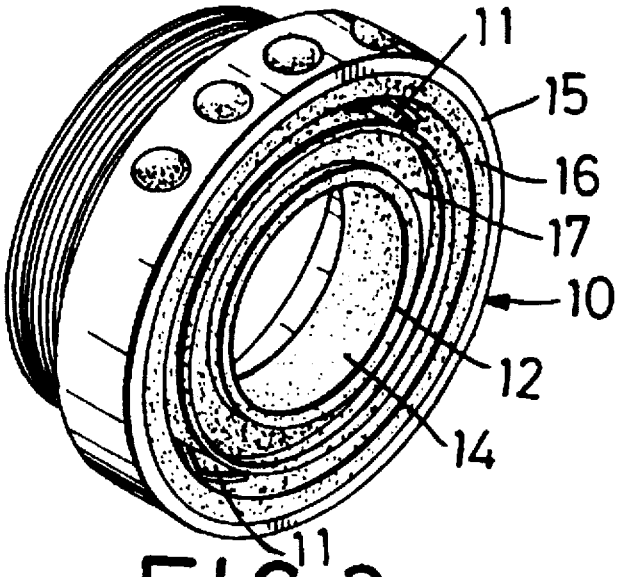
FIG. 2 is a perspective view illustrating a first shockmount member of the handheld microphone of the first preferred embodiment.
Figure 3:
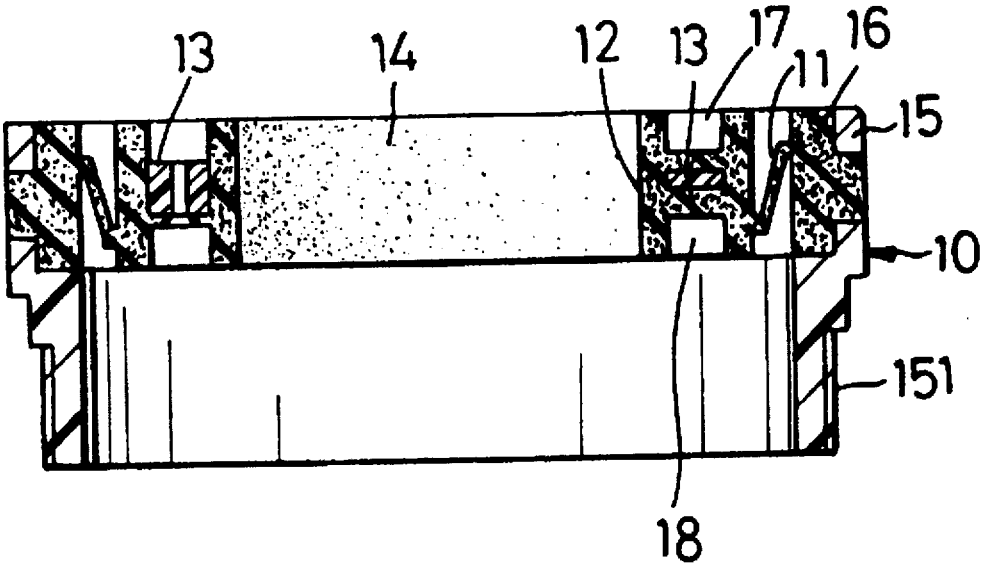
FIG. 3 is a cross-sectional view of the first shockmount member of FIG. 2.
Figure 6:
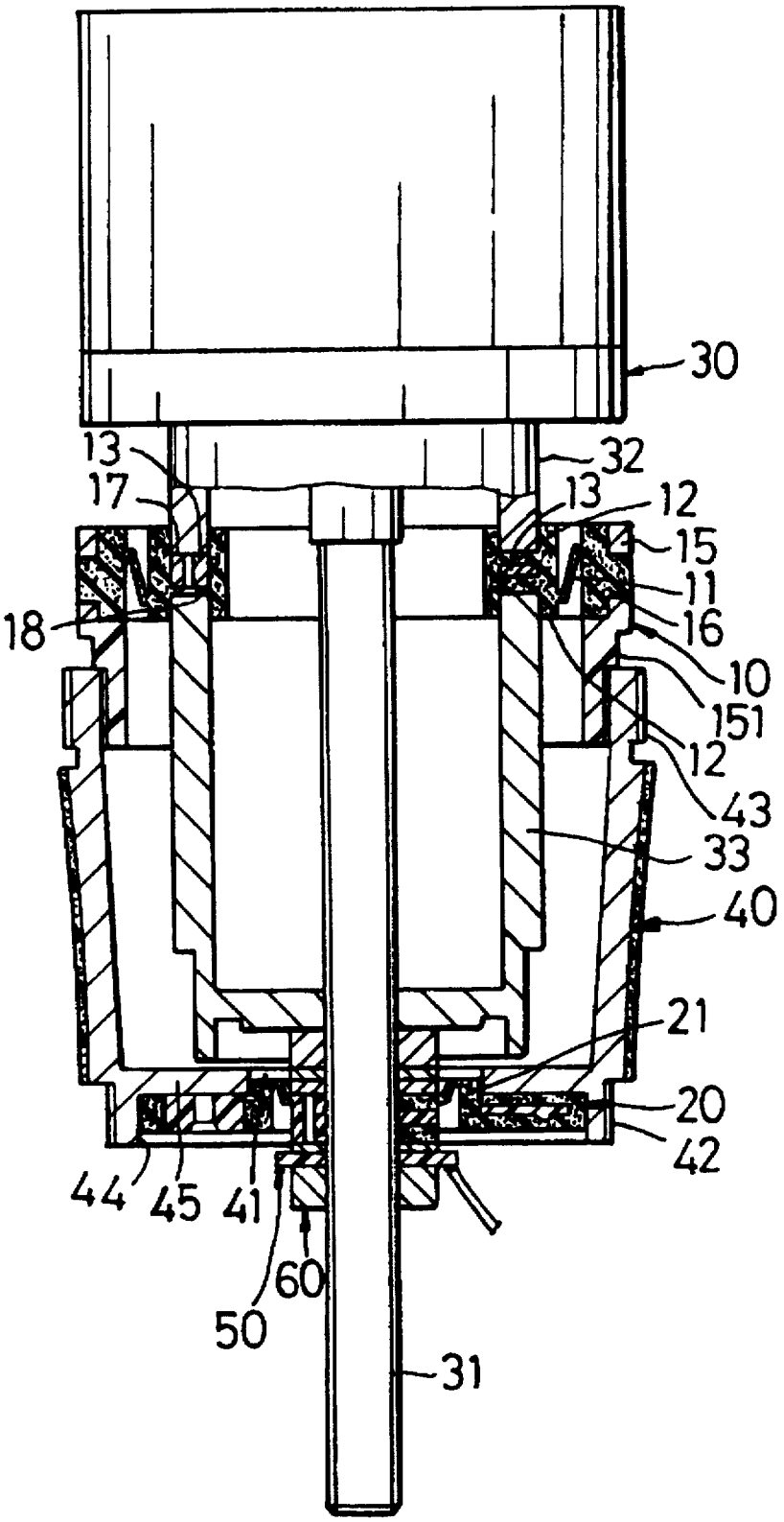
FIG. 6 is a partly sectional view of the handheld microphone of the first preferred embodiment in which the perforated cap and the hollow handle member are removed for the sake of clarity.

Referring to FIGS. 2, 3 and 6, the first shockmount member 10 is mounted between the pick-up head 32 and the tubular end portion 33 of the pick-up device 30. The first shockmount member 10 has a rigid inner ring portion 13, a resilient inner ring portion 12, a rigid outer ring portion 15, a resilient outer ring portion 16, and four resilient connecting strips 11. The rigid inner ring portion 13 is disposed between the pick-up head 32 and the tubular end portion 33 of the pick-up device 30. The rigid inner ring portion 13 confines an axial hole 14 for passage of the shank 31 therethrough. The resilient inner ring portion 12 substantially encloses the rigid inner ring portion 13. The rigid outer ring portion 15 is disposed around the rigid inner ring portion 13. The resilient outer ring portion 16 is secured to an inner side of the rigid outer ring portion 15. The resilient connecting strips 11 interconnect the resilient inner and outer ring portions 12, 16 and are formed integrally with the resilient inner and outer ring portions 12, 16. Each of the resilient connecting strips 11 inclines upwardly and outwardly from the resilient inner ring portion 12 to the resilient outer ring portion 16. The rigid outer ring portion 15 has a downward extension 151 formed with an external screw thread which engages the internal screw thread of the second threaded end 43 of the coupling member 40 so as to fasten the first shockmount member 10 to the coupling member 40. The resilient inner ring portion 12 confines an annular upper retaining groove 17 above the rigid inner ring portion 13 for retaining the pick-up head 32 of the pick-up device 30, and an annular lower retaining groove 18 below the rigid inner ring portion 13 for engaging the tubular end portion 33 of the pick-up device 30.

The resilient connecting strips 11 of the first shockmount member 10 may be replaced by a resilient annular connector which extends along the periphery of the resilient inner ring portion 12 to form a closed loop and which is integrally formed with the resilient inner and outer ring portions 12, 16.

Figure 4:
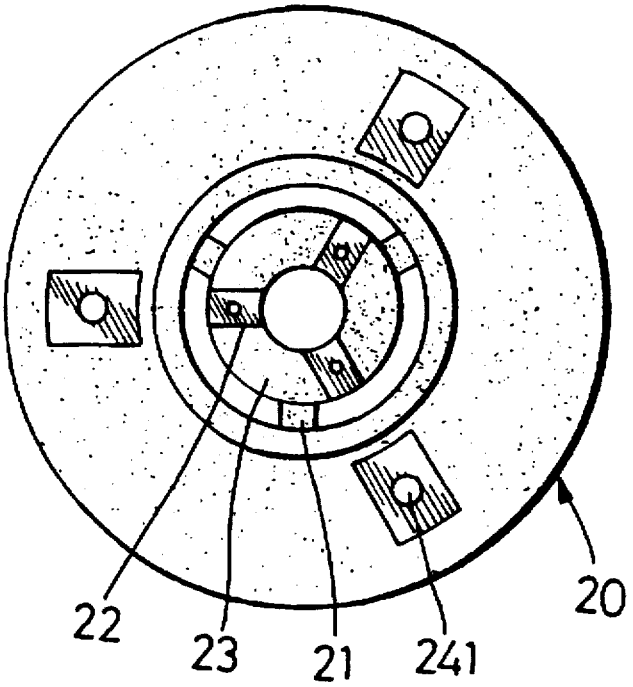
FIG. 4 is a top view of a second shockmount member of the handheld microphone of the first preferred embodiment.
Figure 5:
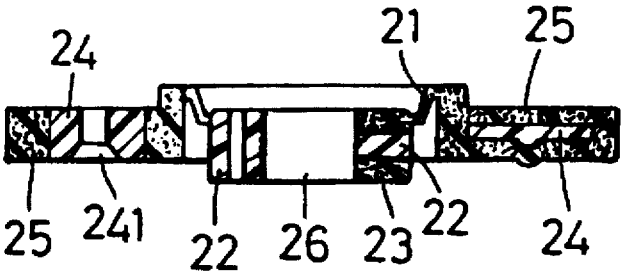
FIG. 5 is a cross-sectional view of the second shockmount member of the handheld microphone of the first preferred embodiment.

Referring to FIGS. 4 to 6, the second shockmount member 20 is received in the recess 44 of the first threaded end 42 of the coupling member 40. The second shockmount member 20 has a rigid inner annular portion 22, a resilient inner annular portion 23, a rigid outer annular portion 24, a resilient outer annular portion 25, and a plurality of connecting strips 21. The rigid inner annular portion 22 confines a central opening 26 to permit extension of the shank 31 of the pick-up device 30 therethrough. The resilient inner annular portion 23 substantially encloses the rigid inner annular portion 22. The rigid outer annular portion 24 is disposed around the rigid inner annular portion 22. The resilient outer annular portion 25 substantially encloses the rigid inner annular portion 24. Each of the resilient connecting strips 21 interconnects the resilient inner and outer annular portions 23, 25 and is integrally formed with the resilient inner and outer annular portions 23, 25. Each of the resilient connecting strips 21 inclines upwardly and outwardly from the resilient inner annular portion 23 to the resilient outer annular portion 25. The rigid outer annular portion 24 is formed with three fastener holes 241, each of which is provided with a screw fastener (not shown) for fastening the second shockmount member 20 to the base wall 45 of the coupling member 40. However, the second shockmount member 20 may also be directly secured to the base wall 45 by means of adhesives.

The resilient connecting strips 21 of the second shockmount member 20 may also be replaced by a resilient annular connector which extends along the periphery of the resilient inner ring portion 12 to form a closed loop and which is integrally formed with the resilient inner and outer ring portions 12, 16.

The rigid inner and outer ring portions 13, 15 of the first shockmount member 10 and the rigid inner and outer annular portions 22, 24 of the second shockmount member 20 are made of a rigid plastic or metal with a hardness of greater than 80 degrees by injection molding. The resilient inner and outer ring portions 12, 16 and the connecting strips 11 of the first shockmount member 10 and the resilient inner and outer annular portions 23, 25 and the connecting strips 21 of the second shockmount member 20 are made of a resilient rubber with a hardness of below 50 degrees.

With the provision of the resilient connecting strips 11, 21, the first and second shockmount members 10, 20 protect and isolate the pick-up device 30 of the microphone from external vibrations during handling of the microphone. The first and second shockmount members 10, 20 cooperatively achieve a double shockmount effect. Static noise can thus be minimized.

Figure 7:
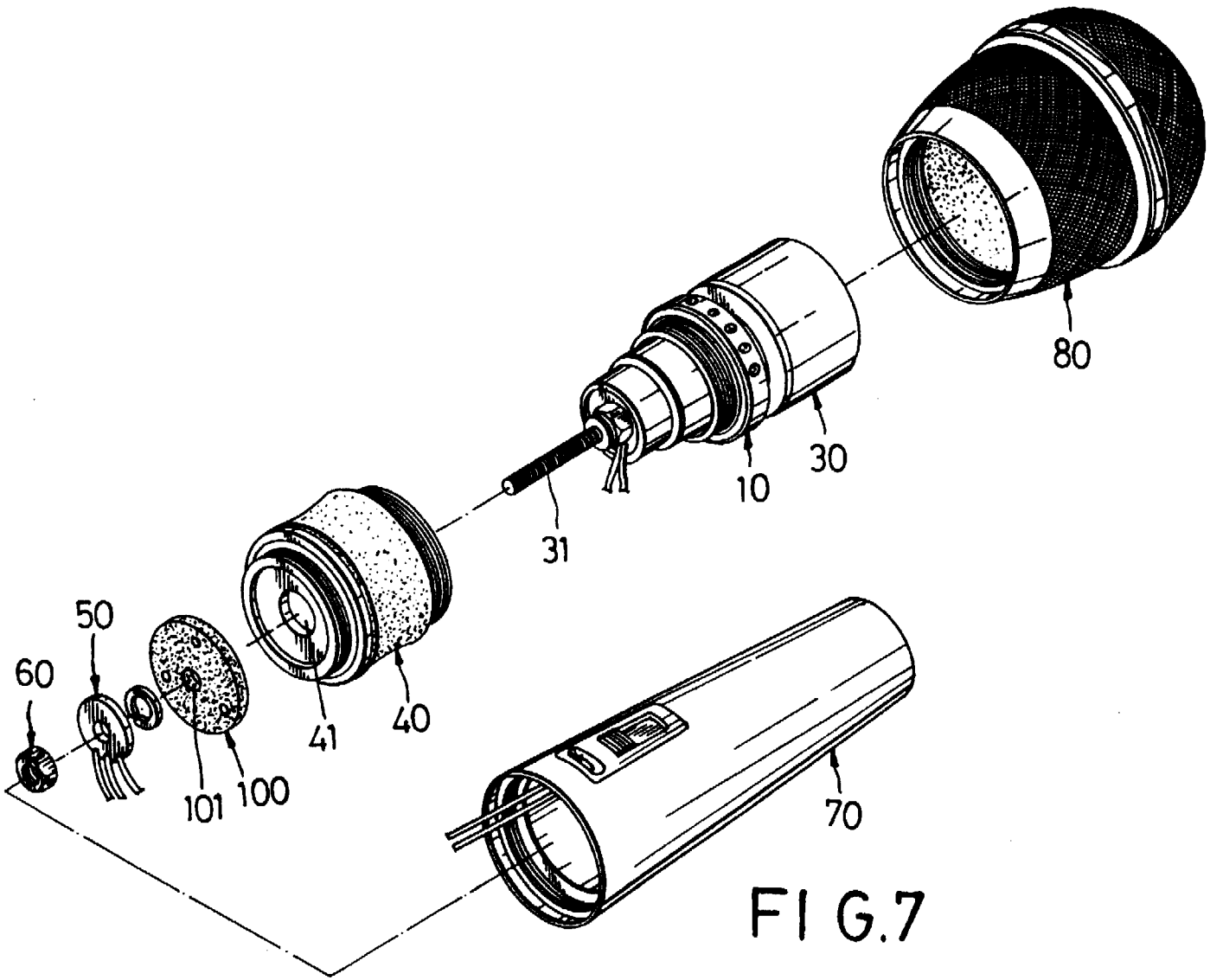
FIG. 7 is an exploded perspective view illustrating the handheld microphone according to a second preferred embodiment of this invention.

Referring to FIG. 7, in a second preferred embodiment, the second shockmount member 20 is replaced by an annular buffering sponge 100 that confines a central hole 101 to permit extension of the shank 31 of the pick-up device 30 therethrough. The buffering sponge 100 also achieves a shock-absorbing effect and helps to protect the pick-up device 30 from vibrations.

With this invention thus explained, it is apparent that numerous modifications and variations can be made without departing from the scope and spirit of this invention. It is therefore intended that this invention be limited only as indicated in the appended claims.

I claim:

1. A handheld microphone comprising:

a housing which includes a hollow handle member, a coupling member having a first threaded end fastened to said hollow handle member and a second threaded end, and a perforated cap fastened to said second threaded end of said coupling member, said first threaded end of said coupling member being formed with a recess which has a base wall, said base wall being formed with an opening;

a pick-up device having a pick-up head extending into said cap, a tubular end portion extending into said coupling member, and an axial shank which extends through said opening in said base wall and which is fastened to said base wall by means of a nut; and a first shockmount member mounted between said pick-up head and said tubular end portion of said pick-up device, said first shock mount member having a rigid inner ring portion which is disposed between said pick-up head and said tubular end portion of said pick-up device and which confines an axial hole for passage of said shank of said pick-up device therethrough, a resilient inner ring portion which substantially encloses said rigid inner ring portion, a rigid outer ring portion which is disposed around said rigid inner ring portion, a resilient outer ring portion which is secured to an inner side of said rigid outer ring portion, and a resilient connector which interconnects said resilient inner and outer ring portions, said rigid outer ring portion being fastened to said second threaded end of said coupling member.

2. The handheld microphone according to claim 1, wherein said resilient inner ring portion of said first shockmount member confines an annular upper retaining groove above said rigid inner ring portion for retaining said pick-up head of said pick-up device, and an annular lower retaining groove below said rigid inner ring portion for engaging said tubular end portion of said pick-up device.

3. The handheld microphone according to claim 1, wherein said resilient connector includes a plurality of connecting strips that incline upwardly and outwardly from said resilient inner ring portion to said resilient outer ring portion.

4. The handheld microphone according to claim 1, wherein said rigid outer ring portion of said first shockmount member has a downward extension formed with an external screw thread, said second threaded end of said coupling member being formed with an internal screw thread which engages said external screw thread of said rigid outer ring portion of said first shockmount member for fastening said first shockmount member to said coupling member.

5. The handheld microphone according to claim 1, further comprising a second shockmount member which is received in said recess of said first threaded end of said coupling member, said second shockmount member having a rigid inner annular portion which confines a central opening to permit extension of said shank of said pick-up device therethrough, a resilient inner annular portion which substantially encloses said rigid inner annular portion, a rigid outer annular portion which is disposed around said rigid inner annular portion, a resilient outer annular portion which substantially encloses said rigid outer annular portion, and a resilient connector which interconnects said resilient inner and outer annular portions.

6. The handheld microphone according to claim 5, wherein said resilient connector includes a plurality of connecting strips that incline upwardly and outwardly from said resilient inner annular portion to said resilient outer annular portion.

7. The handheld microphone according to claim 5, wherein said rigid outer annular portion of said second shockmount member is formed with at least one fastener hole that is provided with a fastener to fasten said second shockmount member to said base wall of said coupling member.

8. The handheld microphone according to claim 1, further comprising an annular buffering sponge which is received in said recess of said first threaded end of said coupling member.

* * * * *